US008783209B2

(12) United States Patent
Kaku et al.

(10) Patent No.: US 8,783,209 B2
(45) Date of Patent: Jul. 22, 2014

(54) APPARATUS AND PROCESS FOR PRODUCING ELECTROPHOTOGRAPHIC PHHOTOSENSITIVE MEMBER

(75) Inventors: Kenichi Kaku, Suntou-gun (JP); Yasuhiro Kawai, Susono (JP); Masaki Nonaka, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 875 days.

(21) Appl. No.: 12/548,916

(22) Filed: Aug. 27, 2009

(65) Prior Publication Data

US 2010/0062171 A1 Mar. 11, 2010

(30) Foreign Application Priority Data

Sep. 9, 2008 (JP) ..... 2008-231193

(51) Int. Cl.

| | |
|---|---|
| ***B05C 3/02*** | (2006.01) |
| ***B05C 11/11*** | (2006.01) |
| ***B05C 13/00*** | (2006.01) |
| ***B05C 3/10*** | (2006.01) |
| ***B05C 3/09*** | (2006.01) |
| ***G03G 5/05*** | (2006.01) |
| *B05D 1/18* | (2006.01) |

(52) U.S. Cl.

CPC ... *B05C 3/10* (2013.01); *B05C 3/09* (2013.01); *G03G 5/0525* (2013.01); *B05D 1/18* (2013.01)

USPC ..... 118/423; 118/408; 118/412; 118/428; 118/429; 118/505; 427/430.1

(58) Field of Classification Search

CPC ..... B05C 3/10; B05C 3/09; G03G 5/0525

USPC ..... 118/400, 407, 423, 428, 500, 505; 430/56, 127, 133; 427/430.1

See application file for complete search history.

(56) References Cited

U.S. PATENT DOCUMENTS

| | | | | |
|---|---|---|---|---|
| 5,720,815 | A * | 2/1998 | Swain | 118/407 |
| 5,725,667 | A * | 3/1998 | Petropoulos et al. | 118/407 |
| 6,010,572 | A * | 1/2000 | Furusawa et al. | 118/408 |
| 2002/0150832 | A1 * | 10/2002 | Kinoshita et al. | 118/400 |
| 2003/0037727 | A1 * | 2/2003 | Yasuda et al. | 118/400 |

FOREIGN PATENT DOCUMENTS

| | | |
|---|---|---|
| JP | 07-104488 | 4/1995 |
| JP | 2002-162760 A | 6/2002 |
| JP | 3-797532 | 7/2006 |
| JP | 3797532 | 7/2006 |
| JP | 2007-086176 | 4/2007 |
| JP | 2007-206151 | 8/2007 |

* cited by examiner

*Primary Examiner* — Dah-Wei D Yuan
*Assistant Examiner* — Binu Thomas
(74) *Attorney, Agent, or Firm* — Fitzpatrick, Cella, Harper and Scinto

(57) ABSTRACT

The present invention provides an apparatus for producing an electrophotographic photosensitive member that has a coating machine for dipping plural members to be coated in a coating liquid in a coating bath and then lifting up the coated members to form a coating film on the surface of each of the plural members to be coated and a transport holding member for holding and transporting the members to be coated, and has plural stretching hoods which can individually cover each side of the plural members to be coated and can extend in association with the movement of the plural members to be coated to individually cover each side of the plural members to be coated when the coating machine is lifting up the plural members to be coated, wherein the plural stretching hoods are linked with each other at the lower parts of the hoods.

6 Claims, 6 Drawing Sheets

APPARATUS AND PROCESS FOR PRODUCING ELECTROPHOTOGRAPHIC PHHOTOSENSITIVE MEMBER

BACKGROUND OF THE INVENTION

1. Field of the Invention

The present invention relates to an apparatus for producing an electrophotographic photosensitive member wherein the apparatus has stretching hoods which can cover members to be coated individually when forming coating films on each surface of the plural members to be coated by dip coating, and a process for producing an electrophotographic photosensitive member by employing the apparatus.

2. Description of the Related Art

Electrophotographic photosensitive members for use in copiers and laser beam printers are produced by forming a photosensitive layer on the surface of the members to be coated containing a support. Dip coating method, which can form a photosensitive layer at the same time on each surface of the plural members to be coated, is often adopted in the production process for the reason that the method is space-saving and of low cost.

The dip coating method is a method containing steps of dipping a member to be coated in a coating liquid for photosensitive layer or the like placed in a coating bath, lifting up the coated member from the coating liquid, and then drying the coating film formed on the surface of the member to be coated. The dip coating method is thus easy to perform and facilitates mass production (simultaneous coating of plural members). However, the state of the solvent vapor present around the member to be coated may vary affected by airflow from the outside when the coated member is lifted up from the coating bath. On this account, the dip coating method has a problem that irregularities may occur in the coating film formed on the surface of the member to be coated.

Japanese Patent Application Laid-Open No. 2007-086176, Japanese Patent No. 3797532 and Japanese Patent Application Laid-Open No. H07-104488 disclose a technique of providing a hood around a member to be coated for overcoming this problem. In addition, Japanese Patent Application Laid-Open No. 2007-206151 discloses a technique of providing a hood covering up the whole of the plural members to be coated. These techniques intend to control the airflow from the outside with a hood and to suppress the occurrence of the irregularities of the coating film. In addition, these hoods are constructed as stretching hoods so that the hoods can extend in association with the movement of the member to be coated when the member to be coated is lifted up.

However, when such a stretching hood for covering the whole of the plural members to be coated as disclosed in Japanese Patent Application Laid-Open No. 2007-206151 is used, difference will be caused between the state of the solvent vapor present around the members to be coated disposed on the outer side and the state of the solvent vapor present around the members to be coated disposed on the inner side in the case where the apparatus is configured so that dip coating of plural members to be coated can be performed at the same time as shown in FIG. 1 of Japanese Patent Application Laid-Open No. 2007-206151. As a result, drying may proceed differently and the condition of the formed coating film may be different between the coating film formed on the surface of the members on the outer side and the coating film formed on the surface of the members on the inner side.

Accordingly, in the case where plural members to be coated are dip coated at the same time, it is necessary to provide plural stretching hoods so as to enable to cover each side of the plural members to be coated individually.

However, in the case where plural stretching hoods for covering each side of the plural members to be coated individually are provided as disclosed in Japanese Patent Application Laid-Open No. 2007-086176, Japanese Patent No. 3797532 and Japanese Patent Application Laid-Open No. H07-104488, plural stretching hoods are disposed in a limited space and inconvenient situation that adjacent stretching hoods touch with each other may occur. When dip coating of plural members to be coated is performed in such a condition, the stretching hoods may interfere with each other, resulting in difference in the individual extension and contraction movement among of the stretching hoods, and the state of the solvent vapor around the plural members to be coated will become different. In addition, when the extension and contraction operation of the plural stretching hoods is repeated, difference among the stretching hoods may be resulted in the way of the extension and contraction even if there is no interference among the stretching hoods as mentioned above. As a result, even if the airflow from the outside can be suppressed by using the stretching hoods, the difference in the state of the solvent vapor around the members to be coated will result in the difference in the irregularities of the coating film among the produced plural electrophotographic photosensitive members, thus causing individual difference in the electrophotographic characteristics.

SUMMARY OF THE INVENTION

An object of the present invention is to provide an apparatus for producing an electrophotographic photosensitive member which apparatus can suppress variation of the coating film among the produced plural electrophotographic photosensitive members and thereby suppressing individual difference of the electrophotographic photosensitive members even when plural stretching hoods for individually covering each side of the plural members to be coated are used; and a process for producing an electrophotographic photosensitive member using the production apparatus.

The present invention is directed to an apparatus for producing an electrophotographic photosensitive member that has a coating machine for dipping plural members to be coated in a coating liquid in a coating bath and then lifting up the coated members to form a coating film on the surface of each of the plural members to be coated and a transport holding member for holding and transporting the members to be coated, and has plural stretching hoods which can individually cover each side of the plural members to be coated and can extend in association with the movement of the plural members to be coated to individually cover each side of the plural members to be coated when the coating machine is lifting up the plural members to be coated, wherein the plural stretching hoods are linked with each other at the lower parts of the hoods.

The present invention is also directed to a process for producing an electrophotographic photosensitive member having the step for forming a photosensitive layer on each surface of the plural members to be coated using the production apparatus mentioned above.

According to the present invention, it is possible to provide an apparatus for producing an electrophotographic photosensitive member which can suppress nonuniformity in the coating film among the produced plural electrophotographic photosensitive members and thereby suppressing individual difference of the electrophotographic photosensitive members even when plural stretching hoods for individually covering each side of the plural members to be coated are used; and a process for producing an electrophotographic photosensitive member using the production apparatus.

Further features of the present invention will become apparent from the following description of exemplary embodiments with reference to the attached drawings.

DESCRIPTION OF THE EMBODIMENTS

Figure 1:
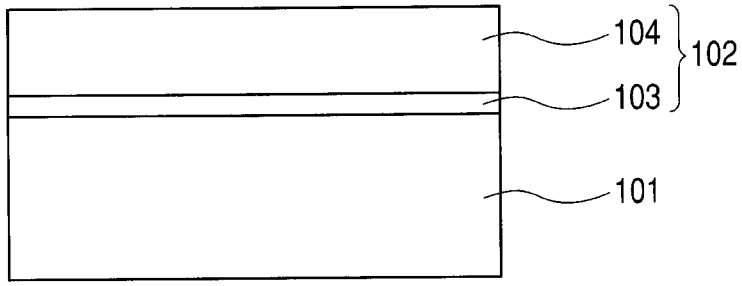
FIG. 1 illustrates an example of an outlined structure of an electrophotographic photosensitive member having a laminate type (functions separated type) photosensitive layer.

The apparatus for producing an electrophotographic photosensitive member according to the present invention has a coating machine for dipping plural members to be coated in a coating liquid in a coating bath and then lifting up the coated members to form a coating film on the surface of each of the plural members to be coated and a transport holding member for holding and transporting the members to be coated. Furthermore, the apparatus for producing an electrophotographic photosensitive member according to the present invention has also plural stretching hoods which can individually cover each side of the plural members to be coated and the plural stretching hoods are linked with each other at the lower parts of the hoods.

The plural stretching hoods may be attached to the coating machine, for example, or attached to the transport holding member.

The stretching hoods of the present invention can move in association with the dipping and lifting movement of the members to be coated and can contract at the time of the dipping and can extend at the time of the lifting. It is also preferable that the stretching hoods extend to a length sufficient to cover the whole of the members to be coated in the longitudinal direction (lifting direction) when the members to be coated are lifted off the coating liquid in the coating bath.

The construction of the stretching hoods is not particularly limited as long as the extension and contraction movement mentioned above is possible, but it suitable that the stretching hoods can keep a certain distance from the outer peripheral surface of the members to be coated. Therefore, the stretching hoods are preferably constructed so that they have a-circular section when the members to be coated have a circular section (i.e., when the members to be coated are in a cylindrical or columnar shape). Examples of the stretching hoods as constructed above include an accordion-like hood having a repeating structure of mountain folds and valley folds and a slide hood consisting of plural pipes (cylinders). In the present invention, it is preferable to use a slide hood. Some of the reasons why a slide hood is favorable are that the slide hood is easy to perform an extension and contraction movement in the vertical direction by linking the hoods at the lower parts thereof and that abnormality in the extension and contraction movement due to the dislocation of the stretching hoods, which in turn is caused by the rolling at the time of the dipping and lifting or transporting the members to be coated, is hard to occur.

Examples of the method for linking the stretching hoods with each other at the lower parts of the hoods include a linking method through a rigid or elastic linking members and a method of directly bonding the stretching hoods with an adhesive. In the present invention, it is preferable to link through a rigid or elastic linking member, and particularly a method of linking through a rigid linking member is more preferable.

Figure 3A:
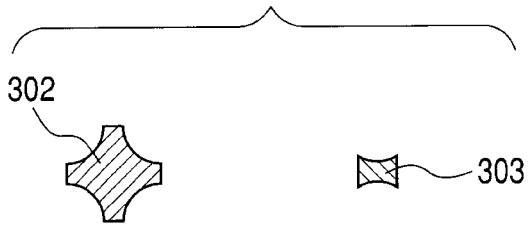
FIG. 3A illustrates an example of a linking member.
Figure 3B:
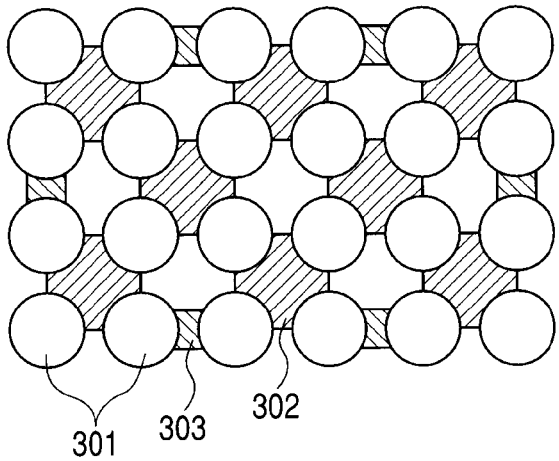
FIG. 3B illustrates an example in which the stretching hoods are linked using plural linking members.
Figure 3C:
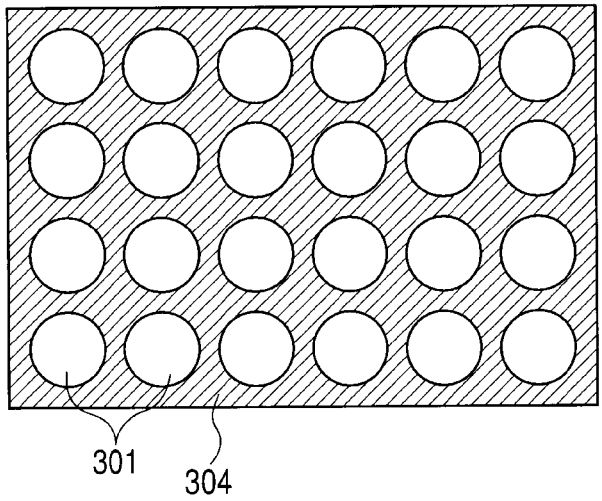
FIG. 3C illustrates an example in which the stretching hoods are linked using a single/united linking member.

When linking the stretching hoods with each other, it is preferable to use a linking member having shape along with the outer peripheral surface of the stretching hoods as shown in FIG. 3A. For linking members, a large number of small members may be used or a small number of large members may be used. An example of fixing stretching hoods with plural linking members is shown in FIG. 3B. In addition, it is more preferable to bore openings the diameter of which is the same as the outer diameter of the stretching hoods in a metallic plate to utilize the openings for linking plural stretching hoods with each other as shown in FIG. 3C since such a construction is advantageous in that the positions of the central axis of the stretching hoods and the central axis of the members to be coated can be precisely aligned. In FIGS. 3A, 3B, and 3C, stretching hoods 301 are linked with each other by linking members 302, 303 and 304.

In the present invention, the position at which the plural stretching hoods are linked with each other is at least the lower parts of the hoods. The problem that abnormality occurs in the extension and contraction movement during dip coating due to horizontal dislocation (for example, a few mm) of the lower parts of the stretching hoods, which in turn is caused by the repetition of the extension and contraction movement can be suppressed by linking plural stretching hoods each other at the lower parts of the hoods. The stretching hoods may be linked at plural positions as long as the extension and contraction movement is not inhibited, and when the hoods are linked at the upper parts and/or middle parts of the hoods, it is enabled to further suppress abnormality of the extension and contraction movement. In particular, difference in the movement among the stretching hoods, which may occur when the stretching hoods are contracted at the time of the dipping of the members to be coated, can be suppressed by linking the hoods at the upper parts, and thereby it is enabled keep the upper ends of the stretching hoods aligned.

The "upper part" or "lower part" of the hood as mentioned herein respectively means the range of 10 cm from the upper end or lower end in the state that the stretching hood are stretched and the "middle part" means the part excluding the range of 10 cm from the upper end and the range of 10 cm from the lower end. However, when the stretching hood is a slide hood consisting of plural cylinders, the "upper part" of the hood means the uppermost cylinder of the plural cylinders, and any part of the uppermost cylinder may be used as the linking site. The "lower part" of the hood means the lowermost cylinder of the plural cylinders, and any part of the lowermost cylinder may be used as the linking site.

As mentioned above, the plural stretching hoods may be attached to the coating machine or attached to the transport holding member. However, in the case that the plural stretching hoods are attached to the transport holding member, the parts of the plural stretching hoods which are not attached to the transport holding member may be dislocated when the transportation speed of the member to be coated is fast. Therefore, it is more preferable that the plural stretching hoods are attached to the coating machine. As a method to attach the plural stretching hoods to the coating machine or the transport holding member, a construction of hanging from the coating machine or the transport holding member with a chain, wire or high-strength wire is preferably adopted since in this case, the positions of the central axis of the stretching hoods and the central axis of the members to be coated can be precisely aligned. In addition, it is preferable to attach lower end parts of the plural stretching hoods to the upper cover fixed on the coating bath, particularly when the plural stretching hoods are attached to the coating machine. The horizontal dislocation of the lower end parts of the stretching hoods is suppressed by attaching the lower end parts of the plural stretching hoods to the upper cover, and thereby the abnormality in the extension and contraction movement can be further suppressed.

Next, the process for producing an electrophotographic photosensitive member using the production apparatus of the present invention will be described.

The electrophotographic photosensitive members are generally produced by forming a photosensitive layer on a support. The photosensitive layer may be a single layer type photosensitive layer containing a charge transport material and a charge generating material in the same layer, or may be a laminate type photosensitive layer (functions separated type) in which the functions are separated in a charge transport layer containing a charge transport material and a charge generating layer containing a charge generating material. The photosensitive layer is preferably a laminate type photosensitive layer in view of electrophotographic characteristics. FIG. 1 illustrates an example of an outlined structure of the electrophotographic photosensitive member having the laminating type (functions separated type) photosensitive layer. In FIG. 1, a support 101, a photosensitive layer 102, a charge generating layer 103, and a charge transport layer 104 are shown. Among the laminating type photosensitive layers, a type (normal order layer type photosensitive layer) in which a charge generating layer and a charge transport layer are laminated in this order from the support side is preferable. An electrically conductive layer and an intermediate layer described below may be provided between the support and the photosensitive layer, and a protective layer described below may be provided on the photosensitive layer.

Here, the "coating film" mentioned above may be an electrically conductive layer, an intermediate layer or a photosensitive layer (charge generating layer and charge transport layer), or a protective layer, or may be other layer(s). In addition, the "member to be coated" mentioned above means a member on the surface of which such a "coating film" is formed. For example, when the electrophotographic photosensitive member is prepared by forming an electrically conductive layer, an intermediate layer, a charge generating layers a charge transport layer and a protective layer in this order on a support:

if the "coating film" is an electrically conductive layer, the "member to be coated" is a support;

if the "coating film" is an intermediate layer, the "member to be coated" is a member having an electrically conductive layer on a support;

if the "coating film" is a charge generating layer, the "member to be coated" is a member having an electrically conductive layer and an intermediate layer formed in this order on a support;

if the "coating film" is a charge transport layer, the "member to be coated" is a member having an electrically conductive layer, an intermediate layer and a charge generating layer formed in this order on a support; and if the "coating film" is a protective layer, the "member to be coated" is a member having an electrically conductive layer, an intermediate layer, a charge generating layer and a charge transport layer formed in this order on a support.

The production apparatus of the present invention is applicable in any of the cases where the "coating film" is any layer mentioned above, and can be applied to plural layers, but the case where the "coating film" is at least a photosensitive layer is preferable.

In the following, the electrophotographic photosensitive member is described in more detail by way of an example having a laminate type photosensitive layer The support may be anything having electrical conductivity (electrically conductive support), and examples thereof include a metal support made of aluminum, stainless steel, nickel or the like, or a support made of a metal, plastic or paper having an electrical conductive film on the surface. The support is preferably in a cylindrical or columnar shape.

These supports may be used as a simple cylinder but one subjected to a physical treatment such as cutting and horning, and/or a chemical treatment such as anodizing processing and a treatment with an acid may be used. Of these, those having a surface roughness adjusted to 0.1 μm or more and 3.0 μm or less in terms of Rz value by performing a physical treatment such as cutting or horning are more preferable from the viewpoint of preventing interference fringes.

An electrically conductive layer may be provided between the support and the photosensitive layer for the purpose of preventing interference fringes and covering surface defects on the support. The electrically conductive layer for the purpose of preventing interference fringes is not necessarily required if the support in itself has been imparted with a function of preventing interference fringes, but when a simple cylinder was used as a support, it is preferable to form an electrically conductive layer thereon having a capability of preventing interference fringes.

The electrically conductive layer can be formed by preparing a coating liquid for electrically conductive layer by dispersing inorganic particles such as tin oxide, indium oxide, titanium oxide and barium sulfate in a solvent with a curable resin such as a phenol resin and applying this coating liquid on the support and performing drying.

The film thickness of the electrically conductive layer is preferably 1 μm or more and 40 μm or less, and more preferably 10 μm or more and 30 μm or less from the viewpoint of capability of preventing interference fringes and covering the surface defects on the support.

An intermediate layer (also referred to as "subbing layer") may be provided between the support or the electrically conductive layer and the photosensitive layer (charge generating layer, charge transport layer) for the purpose of securing close contact with the support or the electrically conductive layer, protecting the photosensitive layer from electrical breakdown and improving carrier injection characteristics of the photosensitive layer.

Examples of the resin usable for the intermediate layer include polyamide, polyvinyl alcohol, polyethylene oxide, ethyl cellulose, casein, polyurethane, polyetherurethane. The intermediate layer can be formed by preparing a coating liquid for the intermediate layer by dissolving these resins in a solvent and applying this coating liquid and performing drying. In addition, a pigment such as an organic pigment and an inorganic pigment may be incorporated in the intermediate layer to adjust the specific volume resistance of the layer.

The film thickness of the intermediate layer is preferably 0.01 μm or more and 10 μm or less, and more preferably 0.1 μm or more and 5 μm or less, in particular.

The charge generating layer can be formed by preparing a coating liquid for the charge generating layer by dispersing a charge generating material along with a binder resin in a solvent and applying this coating liquid and performing drying.

Examples of the charge generating material include azo pigments such as monoazo, bisazo, trisazo, tetrakisazo, phthalocyanines such as gallium phthalocyanine and oxytitanium phthalocyanine and a perylene pigment. Of these, gallium phthalocyanine is preferable from the viewpoint of stability of the electrophotographicelectrophotographic apparatus characteristics when the environment varies. Besides, from the viewpoint of high sensitivity, hydroxy gallium phthalocyanine crystal of a crystalline form having strong peaks at the positions of 7.4°±0.3° and 28.2°±0.3° of Bragg angle 2θ in the CuKα characteristic X-ray diffraction is more preferable.

Examples of the solvent usable for the coating liquid for the charge generating layer include tetrahydrofuran, cyclohexanone, methyl ethyl ketone, ethyl acetate, methanol, methyl cellosolve, acetone, dioxane and N,N-dimethylformamide. When the coating liquid for the charge generating layer is prepared, a binder resin may be added to the solvent along with a charge generating material or after performing dispersing operation only with a charge generating material in the solvent beforehand, the binder resin may be added.

The binder resin for the charge generating layer can be selected from a wide variety of insulating resins and can be selected from organic photoconductivity polymers such as poly-N-vinyl carbazole, polyvinyl anthracene and polyvinylpollen. Examples of the insulating resin include polyvinylbutyral, polyarylate (condensed polymer of bisphenol A and phthalate), polycarbonate, polyester, phenoxy resins, polyvinyl acetate, acrylic resins, polyacrylamide, polyamide, polyvinyl pyridine, cellulosic resins, urethane resins, epoxy resin, caseins, polyvinyl alcohol and polyvinylpyrrolidone.

The film thickness of charge generating layer is preferably not more than 5 μm, and more preferably 0.05 μm or more and 1 μm or less in particular.

The charge transport layer can be formed by preparing a coating liquid for the charge transport layer by dissolving a charge transport material and a binder resin in a solvent and applying this coating liquid and performing drying.

Examples of the charge transport material include various triaryl amine compounds, hydrazone compounds, stilbene compounds, pyrazoline compounds, oxazole compounds, thiazol compounds and triaryl methane compounds. When the coating liquid for the charge transport material layer is prepared, a binder resin may be added to the solvent along with a charge transport material or after dissolving only a charge transport material in the solvent beforehand, the binder resin may be added. As the binder resin, various resins mentioned above can be used.

The film thickness of the charge transport material layer is preferably 5 μm or more and 40 μm or less, and particularly more preferably 10 μm or more and 30 μm or less.

In the present invention, a protective layer may be provided on the photosensitive layer (charge transport layer) for the purpose of improving durability, transfer characteristics and cleaning characteristics.

The protective layer can be formed by preparing a coating liquid for the protective layer by dissolving a resin in a solvent and applying this coating liquid and performing drying. Examples of the resin include polyvinylbutyral, polyester, polycarbonate, polyamide, polyimide, polyarylate, polyurethane, styrene-butadiene copolymer, styrene-acrylic acid copolymer, and styrene-acrylonitrile copolymer.

The protective layer may be formed by curing monomers having charge transport capability or polymer type charge transport materials by various kinds of crosslinking reactions in order to impart the protective layer with charge transport capability. Examples of the curing reaction include radical polymerization, ionic polymerization, thermal polymerization, photopolymerization, radiation polymerization (electron beam polymerization), plasma CVD method and light CVD method.

Furthermore, electrically conductive particles, UV absorbers and abrasion resistance conditioners may be incorporated in the protective layer. For example, for conductive particles, particles of metal oxides such as tin oxide particles are preferable. For abrasion resistance conditioners, fluorine atom containing resin particles, alumina particles and silica particles are preferable.

The film thickness of the protective layer is preferably 0.5 μm or more and 20 μm or less, and particularly more preferably 1 μm or more and 10 μm or less.

Figure 2:
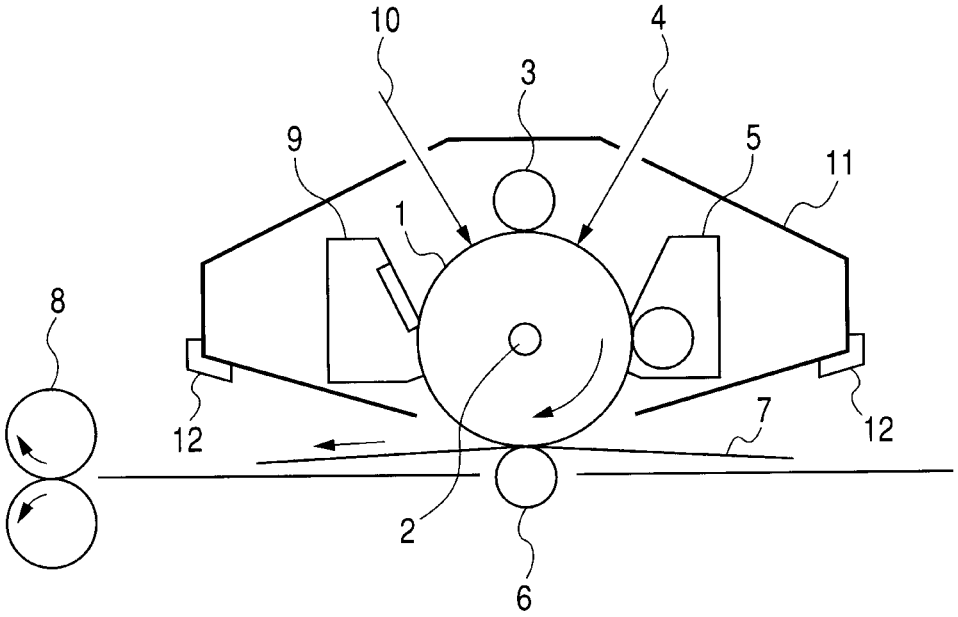
FIG. 2 illustrates an example of an outlined structure of an electrophotographic apparatus including a process cartridge having an electrophotographic photosensitive member of the present invention.

FIG. 2 illustrates an example of an outlined structure of an electrophotographic apparatus including a process cartridge having an electrophotographic photosensitive member produced by the production process of the present invention.

FIG. 2 shows a cylindrical electrophotographic photosensitive member 1, which is driven to turn in the arrow direction at a predetermined circumferential velocity around the axis 2.

The surface of rotary-driven electrophotographic photosensitive member 1 is uniformly charged with electricity to a predetermined positive or negative electric potential with a charging unit (primary charging unit such as charging rollers) 3 and subsequently irradiated with exposure light (image exposing light) 4 from an exposure unit (not illustrated) such as slit exposure or laser beam scanning exposure. An electrostatic latent image corresponding to the objective image is formed sequentially in this way on the surface of electrophotographic photosensitive member 1.

The electrostatic latent image formed on the surface of the electrophotographic photosensitive member 1 is developed with a toner contained in the developer of a developing unit 5 to form a toner image. Subsequently, the toner image formed and carried on the surface of the electrophotographic photosensitive member 1 is sequentially transferred to a transfer material (paper, etc.) 7 under transfer bias by a transfer unit (transfer roller) 6. The transfer material 7 is taken out from a supply unit (not illustrated) synchronizing with the rotation of the electrophotographic photosensitive member 1 and supplied to between the electrophotographic photosensitive member 1 and the transfer unit 6 where both abut against each other.

The transfer material 7 to which the toner image has been transferred is separated from the surface of the electrophotographic photosensitive member 1 and introduced into a fixing unit 8, where the image is fixed, and the fixed image is printed out as an image product (print or copy) to the outside of the apparatus.

The surface of the electrophotographic photosensitive member 1 after the toner image has been transferred is removed of the remaining developer (toner) by a cleaning unit (cleaning blade, etc.) 9 to restore a clean surface, and further removed of electricity by preexposure light 10 from a preexposure unit (not illustrated) and repeatedly used for image formation. A shown in FIG. 2, the preexposure is not necessarily required when the charging unit 3 is a contact electrostatic charge like means using an electrostatic charge roller.

Two or more constituting elements of the electrophotographic photosensitive member 1, charging unit 3, developing unit 5, transfer unit 6 and cleaning unit 9 may be disposed and incorporated in a container to constitute a process cartridge and this process cartridge may be constructed to be attachable and detachable to the main body of an electrophotographic apparatus such as a copier or a laser beam printer. In FIG. 2, the electrophotographic photosensitive member 1, charging unit 3, developing unit 5 and cleaning unit 9 are supported and incorporated into a cartridge and used as a process cartridge 11 which is attachable and detachable to the main body of the electrophotographic apparatus using a guiding unit 12 such as rails of the main body of the electrophotographic apparatus.

In the following, the present invention is described in detail by way of specific examples. However, the embodiment of the present invention is not limited to only these examples. The "part" in the examples means a "mass part."

PRODUCTION APPARATUS EXAMPLES

First, apparatuses for producing the electrophotographic photosensitive member are described.

Production Apparatus Example 1

Figure 4:
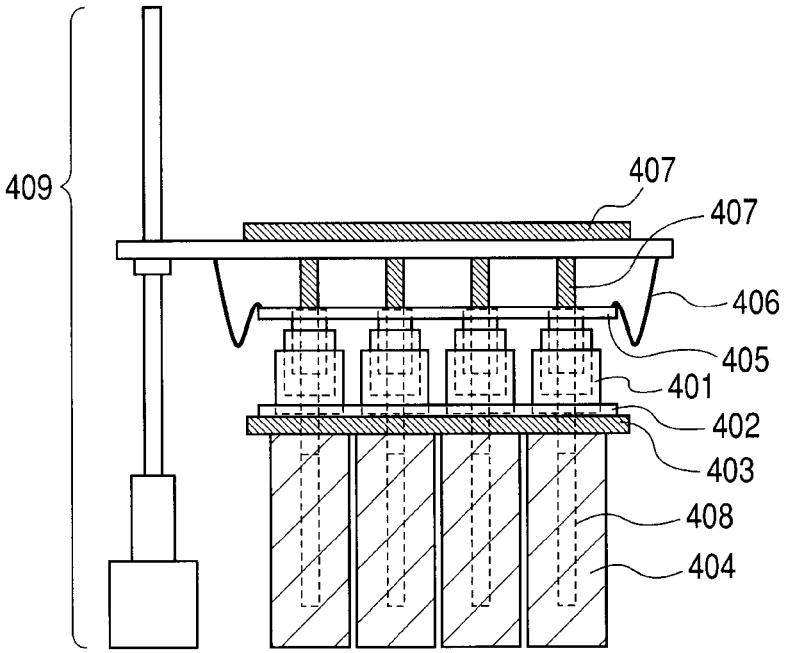
FIG. 4 illustrates Production Apparatus Example 1.
Figure 5:
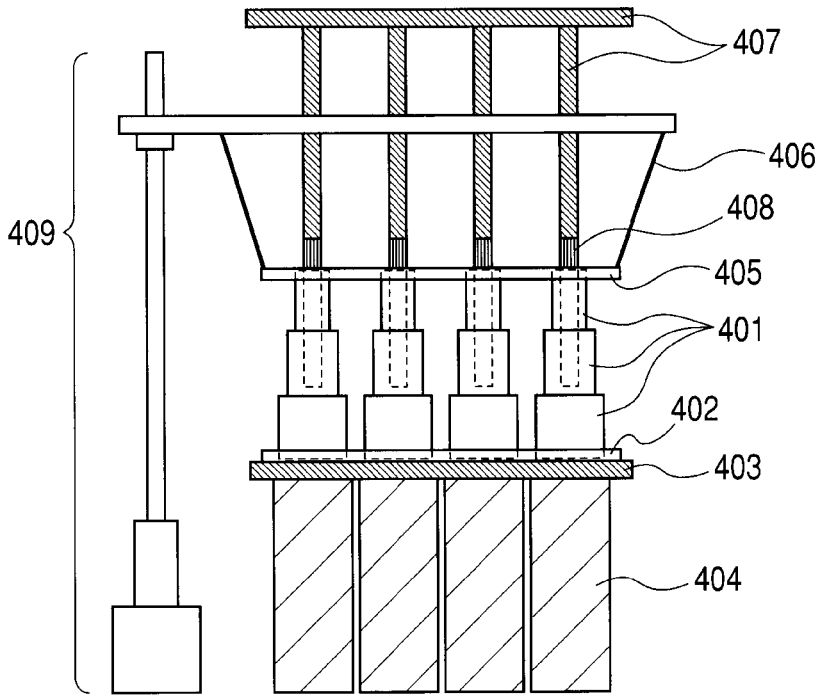
FIG. 5 illustrates Production Apparatus Example 1.

An example (Production Apparatus Example 1) of the apparatus for producing an electrophotographic photosensitive member of the present invention is shown in FIG. 4 and FIG. 5. A slide hood is used as a stretching hood. As the linking unit of the plural stretching hoods (4×6=24), a linking member shown in FIG. 3C is used, and the plural stretching hoods are linked with each other at the lower parts of the hoods. The plural stretching hoods linked each are hung from the upper part of the coating machine with a chain. The plural members to be coated are held (chucked) by the transport holding member which can work individually. In addition, each of the plural stretching hoods is linked to the upper cover of the coating bath at the lower end parts of the hoods. FIG. 4 illustrates the state where the plural members to be coated are being dipped in a coating liquid in the coating bath by descending the coating machine. FIG. 5 illustrates the state where coating films have been formed on each surface of the plural members to be coated by lifting up the transport holding member by the coating machine from the state illustrated in FIG. 4. FIG. 4 and FIG. 5 show slide hoods 401, linking members 402 and 405, an upper cover 403 of a coating bath, the coating bath 404, a hanging chain 406, a transport holding member 407, members to be coated 408 and a coating machine (lift) 409.

Production Apparatus Example 2

Production Apparatus Example 2 is an apparatus having a constitution that is similar to Production Apparatus Example 1 except that the lower end parts of the stretching hoods are not fixed to the upper cover of the coating bath. The members to be coated are dipped in a coating liquid in the coating bath and then lifted up. After the plural stretching hoods linked with each other extend, the lower end parts of the stretching hoods leave the upper cover of the coating bath, and stretching hoods are lifted up while covering the members to be coated and then transported to the next step by a transport holding member.

Production Apparatus Example 3

Production Apparatus Example 3 is an apparatus having a constitution that is similar to Production Apparatus Example 1 except that accordion-like hoods are used as stretching hoods and the lower end parts of the stretching hoods are not fixed to the upper cover of the coating bath. The members to be coated are dipped in a coating liquid in the coating bath and then lifted up. After the plural stretching hoods linked with each other extend, the lower end parts of the stretching hoods leave the upper cover of the coating bath, and stretching hoods are lifted up while covering the members to be coated and then transported to the next step by a transport holding member.

Production Apparatus Example 4

Figure 6:
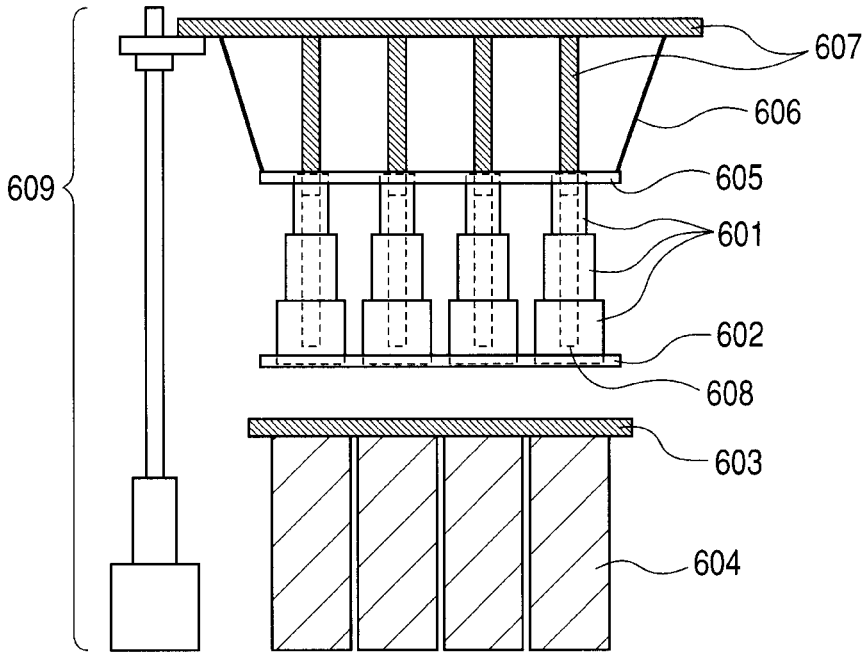
FIG. 6 illustrates Production Apparatus Example 4.

Production Apparatus Example 4 is illustrated in FIG. 6. Production Apparatus Example 4 is an apparatus having a constitution that is similar to Production Apparatus Example 1 except that the plural stretching hoods linked with each other are hanged from the transport holding member by a chain and the lower end parts of the stretching hoods are not fixed to the upper cover of the coating bath. The members to be coated are dipped in a coating liquid in the coating bath and then lifted up. Then the plural stretching hoods linked with each other are lifted up while covering the members to be coated and then transported to the next step by a transport holding member. FIG. 6 shows slide hoods 601, linking members 602 and 605, an upper cover 603 of a coating bath, the coating bath 604, a hanging chain 606, a transport holding member 607, members to be coated 608 and a coating machine (lift) 609.

Production Apparatus Example 5

Production Apparatus Example 5 is an apparatus having a constitution that is similar to Production Apparatus Example 4 except that accordion-like hoods are used as stretching hoods.

Production Apparatus Example 6

Figure 9:
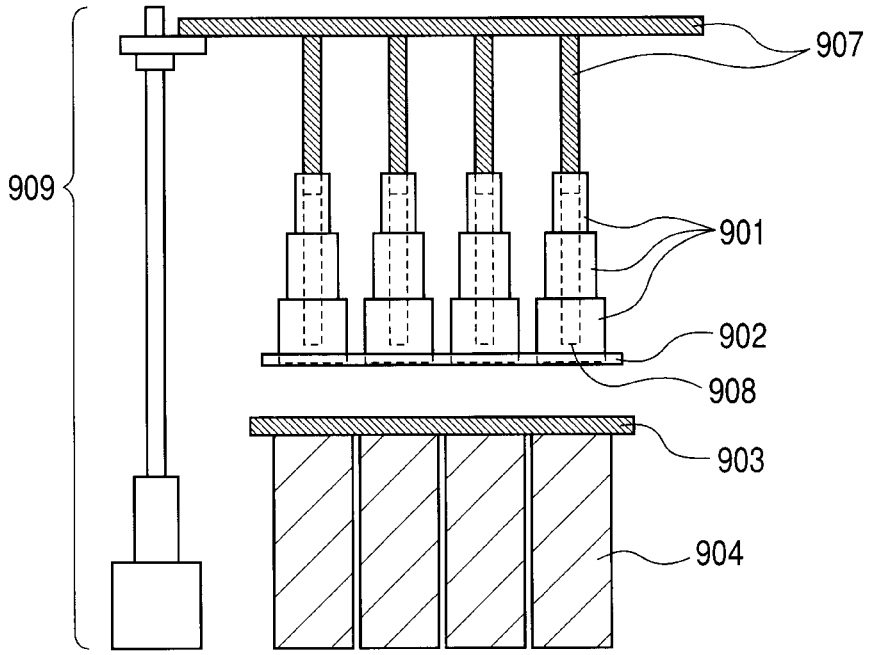
FIG. 9 illustrates Production Apparatus Example 6.

Production Apparatus Example 6 is illustrated in FIG. 9. In Production Apparatus Example 6, the upper ends of the stretching hoods (slide hoods) are directly fixed to the transport holding member and the plural stretching hoods (4×6=24) are linked with each other at the lower parts of the hoods. As the linking unit, a linking member shown in FIG. 3C is used. FIG. 9 shows slide hoods 901, linking members 902, an upper cover 903 of a coating bath, the coating bath 904, a transport holding member 907, members to be coated 908 and a coating machine (lift) 909.

Production Apparatus Example 7

Figure 10:
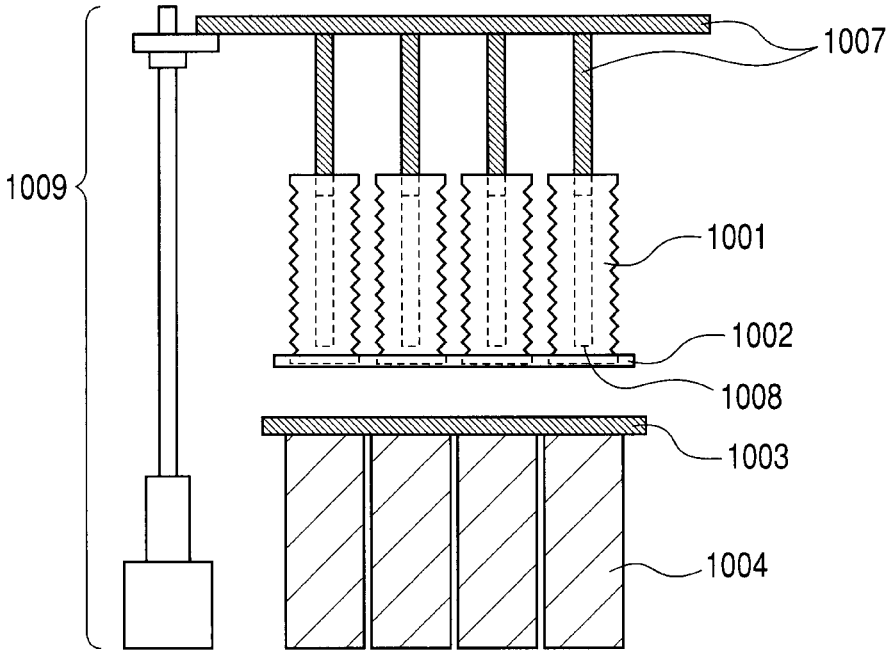
FIG. 10 illustrates Production Apparatus Example 7.

Production Apparatus Example 7 is illustrated in FIG. 10. Production Apparatus Example 7 is an apparatus having a constitution that is similar to Production Apparatus Example 6 except that accordion-like hoods are used in place of the slide hoods as stretching hoods. FIG. 10 shows accordion-like hoods 1001, linking members 1002, an upper cover 1003 of a coating bath, the coating bath 1004, a transport holding member 1007, members to be coated 1008 and a coating machine (lift) 1009.

Production Apparatus Example 8

Figure 7:
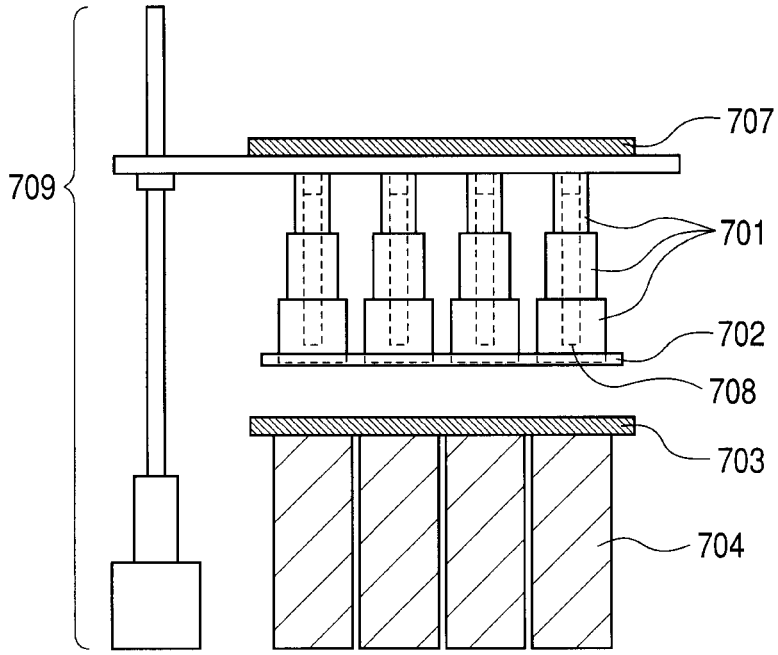
FIG. 7 illustrates Production Apparatus Example 8.

Production Apparatus Example 8 is illustrated in FIG. 7. In Production Apparatus Example 8, slide hoods are used as stretching hoods, and the upper ends of the stretching hoods (slide hoods) directly fixed to the lifting and descending part (arm) of the coating machine (lift). FIG. 7 shows slide hoods 701, linking members 702, an upper cover 703 of a coating bath, the coating bath 704, a transport holding member 707, members to be coated 708 and a coating machine (lift) 709.

Production Apparatus Example 9

Figure 8:
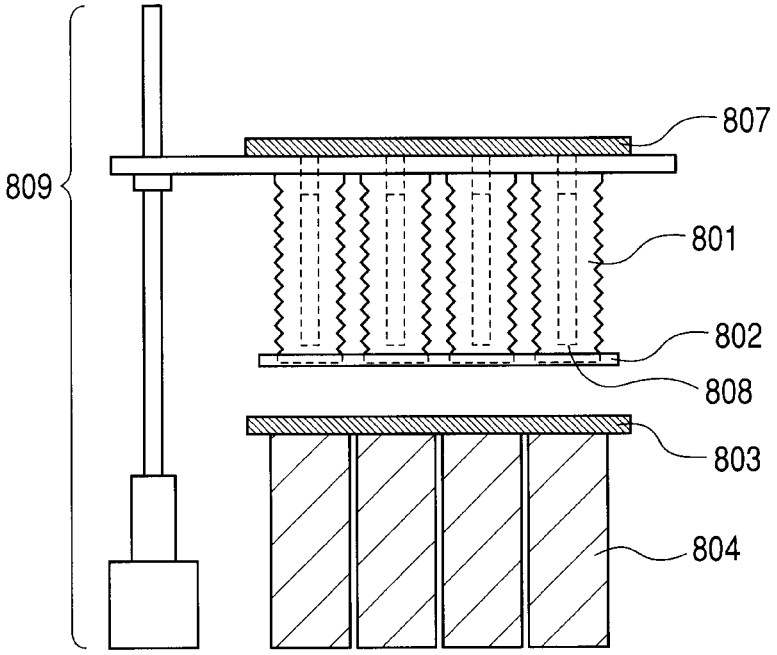
FIG. 8 illustrates Production Apparatus Example 9.

Production Apparatus Example 9 is illustrated in FIG. 8. Production Apparatus Example 9 is an apparatus having a constitution that is similar to Production Apparatus Example 8 except that accordion-like hoods are used in place of the slide hoods as stretching hoods. FIG. 8 shows accordion-like hoods 801, linking members 802, an upper cover 803 of a coating bath, the coating bath 804, a transport holding member 807, members to be coated 808 and a coating machine 809.

Production Example of Electrophotographic Photosensitive Member

The process for producing the electrophotographic photosensitive member of the present invention is described by way of specific production examples of the electrophotographic photosensitive members using Production Apparatus Examples 1 to 9.

Example 1

The coating liquid which was used for the production of the electrophotographic photosensitive member and the production method and evaluation method thereof are described.

<Preparation of Coating Liquid 1 for Intermediate Layer>

While heating and stirring in a water bath of 60° C., 22.5 parts of N-methoxymethylated 6-nylon resin (product name: Tresin EF-30T produced by Nagase ChemteX Corporation; polymerization degree: 420, methoxy methylation ratio: 36.8%) was dissolved in 127.5 parts of ethanol (produced by Kishida Chemical Co., Ltd., special quality).

Subsequently, this solution was allowed to stand still in an environment of relative humidity: 50% and temperature: 23° C., for 12 hours to obtain a gelled polyamide resin GA.

Next, 130.0 parts of the gelled polyamide resin GA were filtered (mesh difference 0.5 mm) while squashing on the sieve to crush to the size equal to or less than 1 mm. To this, 50.0 parts of ethanol (produced by Kishida Chemical Co., Ltd., special quality) and 0.130 part of a diazo compound represented by the following formula (1) were added to obtain an undispersed mixture:

(Formula (1))

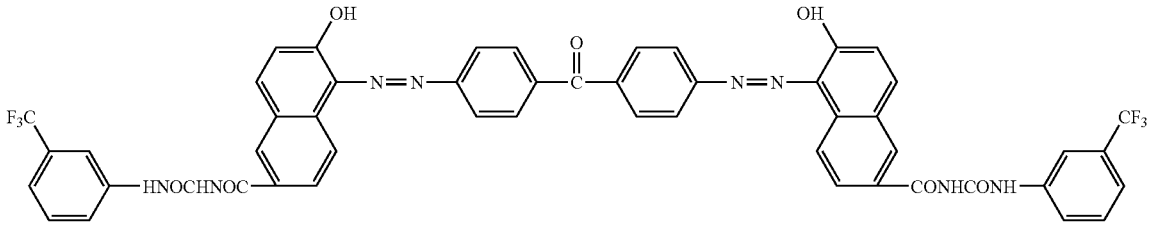

This mixture was subjected to dispersing treatment in a condition of number of revolutions 1500 rpm (circumference speed 5.5 m/s) in a vertical sand mill using 500 parts of glass beads having an average diameter of 0.8 mm as a dispersive medium for 4 hours to obtain dispersion A.

To this dispersion A, 220.3 parts of ethanol (produced by Kishida Chemical Co., Ltd., special quality) and 253.9 parts of n-butanol (produced by Kishida Chemical Co., Ltd., special quality) were added to obtain a coating liquid 1 for intermediate layer.

<Preparation of Coating Liquid 1 for Charge Generating Layer>

10 parts of hydroxy gallium phthalocyanine represented by the following formula (2), 0.1 part of the compound represented by the following formula (3), and 5 parts of a polyvinyl butyral resin (product name: S-LEC BX-1 produced by Sekisui Chemical Co., Ltd.) were added to 250 parts of cyclohexanone and the resultant mixture was subjected to dispersing treatment in a sand mill using glass beads having a diameter of 0.8 mm for 3 hours:

(Formula (2))

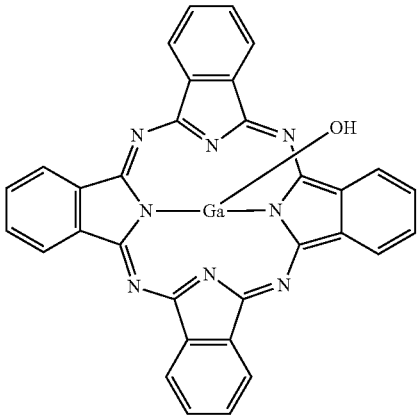

(Formula (3))

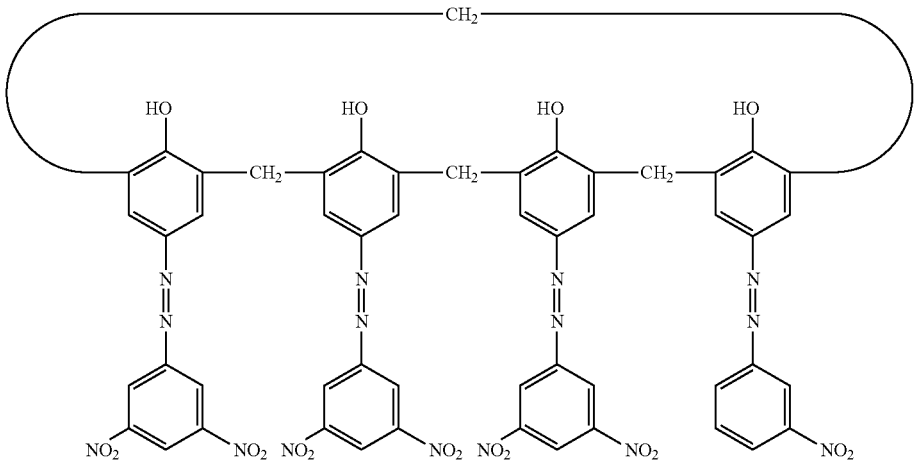

This gave a dispersion of hydroxy gallium phthalocyanine crystal with a crystalline form having strong peaks at the positions of 7.5°, 9.9°, 16.3°, 18.6°, 25.1° and 28.3° of the Bragg angle (2θ±0.2°) in the CuKα characteristic X-ray diffraction.

This dispersion was diluted with 100 parts of cyclohexanone and 450 parts of ethyl acetate to obtain a coating liquid 1 for the charge generating layer.

<Preparation of Coating Liquid 2 for Intermediate Layer>

A mixture consisting of 10 parts of titanium oxide (product name: CREL, produced by Ishihara Sangyo Kaisha, Ltd.), 10 parts of N-methoxymethylated 6-nylon resin (product name: Tresin EF-30T produced by Nagase ChemteX Corporation; polymerization degree: 420, methoxy methylation ratio: 36.8%), 450 parts of methanol (produced by Kishida Chemical Co., Ltd., special quality) and 200 parts of n-butanol (produced by Kishida Chemical Co., Ltd., special quality) was subjected to dispersing treatment in a sand mill using glass beads having a diameter of 0.8 mm for 4 hours to obtain a coating liquid 2 for the intermediate layer.

<Formation of Intermediate Layer 1>

24 cylindrical supports made of aluminum each having an outer diameter of 30 mm and a length of 357.5 mm were dip coated with coating liquid 1 for the intermediate layer using Production Apparatus Example 7 and the resultant coating film was dried at 100° C. for 10 minutes to form an intermediate layer having a film thickness of 0.8 μm. These samples were designated as intermediate layer coating samples 1-1.

The above-mentioned operation was repeated 30 times to prepare 720 intermediate layer coating samples 1-1 and the appearance of every sample was visually examined. The number (defective number) and the ratio (fraction defective) of the prepared intermediate layer coating samples having irregularities among 720 samples were determined. The results are shown in Table 1.

<Formation of Intermediate Layer 2>

24 cylindrical supports made of aluminum each having an outer diameter of 30 mm and a length of 357.5 mm were dip coated with coating liquid 2 for the intermediate layer using Production Apparatus Example 7 and the resultant coating film was dried at 100° C. for 10 minutes to form an intermediate layer having a film thickness of 0.8 μm. These samples were designated as intermediate layer coating samples 1-2.

The above-mentioned operation was repeated 30 times to prepare 720 intermediate layer coating samples 1-2 and the appearance of every sample was visually examined. The number (defective number) and the ratio (fraction defective) of the prepared intermediate layer coating samples having irregularities among 720 samples were determined. The results are shown in Table 2.

<Formation of Charge Generating Layer 1>

Samples in which no irregularities were visually recognized were selected from the intermediate layer coating samples 1-1. These samples were dip coated with coating liquid 1 for the charge generating layer using Production Apparatus Example 7 and the resultant coating film was dried at 100° C. for 10 minutes to form a charge generating layer having a film thickness of 0.2 μm. These samples were designated as electrophotographic photosensitive members 1-3.

The above-mentioned operation was repeated 30 times to prepare 720 electrophotographic photosensitive members 1-3 and the appearance of every sample was visually examined. The number (defective number) and the ratio (fraction defective) of the prepared electrophotographic photosensitive members having irregularities among 720 samples were determined. The results are shown in Table 3.

Example 2

Intermediate layer coating samples 2-1, Intermediate layer coating samples 2-2 and electrophotographic photosensitive members 2-3 were prepared in the similar way as in Example 1 except that the Production Apparatus Example 6 was used in substitution for Production Apparatus Example 7 and visual examination was performed. The results are shown in Tables 1, 2 and 3.

Example 3

Intermediate layer coating samples 3-1, Intermediate layer coating samples 3-2 and electrophotographic photosensitive members 3-3 were prepared in the similar way as in Example 1 except that the Production Apparatus Example 9 was used in substitution for Production Apparatus Example 7 and visual examination was performed. The results are shown in Tables 1, 2 and 3.

Example 4

Intermediate layer coating samples 4-1, Intermediate layer coating samples 4-2 and electrophotographic photosensitive members 4-3 were prepared in the similar way as in Example 1 except that the Production Apparatus Example 8 was used in substitution for Production Apparatus Example 7 and visual examination was performed. The results are shown in Tables 1, 2 and 3.

Example 5

Intermediate layer coating samples 5-1, Intermediate layer coating samples 5-2 and electrophotographic photosensitive members 5-3 were prepared in the similar way as in Example 1 except that the Production Apparatus Example 5 was used in substitution for Production Apparatus Example 7 and visual examination was performed. The results are shown in Tables 1, 2 and 3.

Example 6

Intermediate layer coating samples 6-1, Intermediate layer coating samples 6-2 and electrophotographic photosensitive members 6-3 were prepared in the similar way as in Example 1 except that the Production Apparatus Example 4 was used in substitution for Production Apparatus Example 7 and visual examination was performed. The results are shown in Tables 1, 2 and 3.

Example 7

Intermediate layer coating samples 7-1, Intermediate layer coating samples 7-2 and electrophotographic photosensitive members 7-3 were prepared in the similar way as in Example 1 except that the Production Apparatus Example 3 was used in substitution for Production Apparatus Example 7 and visual examination was performed. The results are shown in Tables 1, 2 and 3.

Example 8

Intermediate layer coating samples 8-1, Intermediate layer coating samples 8-2 and electrophotographic photosensitive members 8-3 were prepared in the similar way as in Example 1 except that the Production Apparatus Example 2 was used in substitution for Production Apparatus Example 7 and visual examination was performed. The results are shown in Tables 1, 2 and 3.

Example 9

Intermediate layer coating samples 9-1, Intermediate layer coating samples 9-2 and electrophotographic photosensitive members 9-3 were prepared in the similar way as in Example 1 except that the Production Apparatus Example 1 was used in substitution for Production Apparatus Example 7 and visual examination was performed. The results are shown in Tables 1, 2 and 3.

Comparative Example 1

Intermediate layer coating samples 11-1 were prepared in the similar way as in Example 1 except that the linking members were removed and the lower parts of the stretching hoods were not linked, and visual examination was performed. The results are shown in Table 1.

Comparative Example 2

Intermediate layer coating samples 12-1 were prepared in the similar way as in Example 2 except that the linking members were removed and the lower parts of the stretching hoods were not linked, and visual examination was performed. The results are shown in Table 1.

Comparative Example 3

Intermediate layer coating samples 13-1 were prepared in the similar way as in Example 4 except that the linking members were removed and the lower parts of the stretching hoods were not linked, and visual examination was performed. The results are shown in Table 1.

TABLE 1

| | Production apparatus used | Intermediate layer coating sample | Number of defectives out of 720 samples produced | Percent defective (%) |
|---|---|---|---|---|
| Example 1 | Production Apparatus Example 7 | 1-1 | 28 | 3.9 |
| Example 2 | Production Apparatus Example 6 | 2-1 | 23 | 3.2 |
| Example 3 | Production Apparatus Example 9 | 3-1 | 19 | 2.6 |
| Example 4 | Production Apparatus Example 8 | 4-1 | 16 | 2.2 |
| Example 5 | Production Apparatus Example 5 | 5-1 | 12 | 1.7 |
| Example 6 | Production Apparatus Example 4 | 6-1 | 9 | 1.3 |
| Example 7 | Production Apparatus Example 3 | 7-1 | 8 | 1.1 |

TABLE 1-continued

| | Production apparatus used | Intermediate layer coating sample | Number of defectives out of 720 samples produced | Percent defective (%) |
|---|---|---|---|---|
| Example 8 | Production Apparatus Example 2 | 8-1 | 6 | 0.8 |
| Example 9 | Production Apparatus Example 1 | 9-1 | 4 | 0.6 |
| Comparative Example 1 | Hoods not linked at lower parts in Example 1 | 11-1 | 50 | 6.9 |
| Comparative Example 2 | Hoods not linked at lower parts in Example 2 | 12-1 | 44 | 6.1 |
| Comparative Example 3 | Hoods not linked at lower parts in Example 4 | 13-1 | 39 | 5.4 |

TABLE 2

| | Production apparatus used | Intermediate layer coating sample | Number of defectives out of 720 samples produced | Percent defective (%) |
|---|---|---|---|---|
| Example 1 | Production Apparatus Example 7 | 1-2 | 26 | 3.6 |
| Example 2 | Production Apparatus Example 6 | 2-2 | 23 | 3.2 |
| Example 3 | Production Apparatus Example 9 | 3-2 | — | — |
| Example 4 | Production Apparatus Example 8 | 4-2 | — | — |
| Example 5 | Production Apparatus Example 5 | 5-2 | 8 | 1.1 |
| Example 6 | Production Apparatus Example 4 | 6-2 | 6 | 0.8 |
| Example 7 | Production Apparatus Example 3 | 7-2 | — | — |
| Example 8 | Production Apparatus Example 2 | 8-2 | 4 | 0.6 |
| Example 9 | Production Apparatus Example 1 | 9-2 | 3 | 0.4 |

TABLE 3

| | Production apparatus used | Electrophotographic photosensitive member | Number of defectives out of 720 samples produced | Percent defective (%) |
|---|---|---|---|---|
| Example 1 | Production Apparatus Example 7 | 1-3 | 20 | 2.8 |
| Example 2 | Production Apparatus Example 6 | 2-3 | 18 | 2.5 |
| Example 3 | Production Apparatus Example 9 | 3-3 | — | — |
| Example 4 | Production Apparatus Example 8 | 4-3 | — | — |
| Example 5 | Production Apparatus Example 5 | 5-3 | 10 | 1.4 |
| Example 6 | Production Apparatus Example 4 | 6-3 | 8 | 1.1 |
| Example 7 | Production Apparatus Example 3 | 7-3 | — | — |
| Example 8 | Production Apparatus Example 2 | 8-3 | 5 | 0.7 |
| Example 9 | Production Apparatus Example 1 | 9-3 | 4 | 0.6 |

As is understood from the comparison between Examples 1 to 4 and Comparative Examples 1 to 3, occurrence of irregularities in the coating film (intermediate layer, charge generating layer) caused by abnormality in the extension and contraction movement of the stretching hoods can be suppressed by fixing the lower parts of the stretching hoods. As is understood from the comparison between Examples 1 to 4 and Examples 5 to 8, occurrence of irregularities in the coating film can be further suppressed by fixing the upper parts of the stretching hoods in addition to the lower parts of the stretching hoods.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-231193, filed Sep. 9, 2008, which is hereby incorporated by reference herein in its entirety.

What is claimed is:

1. An apparatus for producing an electrophotographic photosensitive member, comprising:

a coating machine for dipping plural members to be coated in a coating liquid in a coating bath and then lifting up the coated members to form a coating film on the surface of each of the plural members to be coated;

a transport holding member for holding and transporting the plural members to be coated; and plural stretching hoods which individually cover each side of the plural members to be coated and extend in association with the movement of the plural members to be coated to individually cover each side of the plural members to be coated when the coating machine is lifting up the plural members to be coated, wherein the plural stretching hoods are plural slide hoods comprising plural cylinders, the plural slide hoods are in a state where the plural slide hoods are hanged from the coating machine or the transport holding member, and the plural slide hoods are linked with each other at the uppermost cylinder of the plural cylinders of each slide hood and at the lowermost cylinder of the plural cylinders of each slide hood.

2. The apparatus for producing an electrophotographic photosensitive member according to claim 1, wherein the apparatus comprises the plural slide hoods in a state where the plural slide hoods are hanged from the coating machine.

3. The apparatus for producing an electrophotographic photosensitive member according to claim 1, wherein the lowermost cylinder of the plural cylinders of each slide hood is detached from an upper cover fixed on the coating bath.

4. An apparatus for producing an electrophotographic photosensitive member, comprising:

a coating machine for dipping plural members to be coated in a coating liquid in a coating bath and then lifting up the coated members to form a coating film on the surface of each of the plural members to be coated;

a transport holding member for holding and transporting the members to be coated; and plural stretching hoods which individually cover each side of the plural members to be coated and extend in association with the movement of the plural members to be coated to individually cover each side of the plural members to be coated when the coating machine is lifting up the plural members to be coated, wherein the plural stretching hoods are plural accordion-like hoods, the plural accordion-like hoods are in a state where the plural accordion-like hoods are hanged from the coating machine or the transport holding member, and the plural accordion-like hoods are linked with each other at the upper part of each accordion-like hood and at the lower part of each accordion-like hood.

5. The apparatus for producing an electrophotographic photosensitive member according to claim 4, wherein the lower part of each accordion-like hood is detached from an upper cover fixed on the coating bath.

6. The apparatus for producing an electrophotographic photosensitive member according to claim 4, wherein the apparatus comprises the plural accordion-like hoods in a state where the plural accordion-like hoods are hanged from the coating machine.

* * * * *